US012377511B2

(12) United States Patent
Qiu et al.

(10) Patent No.: US 12,377,511 B2
(45) Date of Patent: Aug. 5, 2025

(54) EDGE POLISHING SYSTEM WITH EDGE ALIGNMENT FUNCTION FOR PLATES

(71) Applicant: VEEGOO TECHNOLOGY CO., LTD., Foshan (CN)

(72) Inventors: Jianping Qiu, Foshan (CN); Luyang Tong, Foshan (CN); Hexing Wen, Foshan (CN)

(73) Assignee: VEEGOO TECHNOLOGY CO., LTD., Foshan (CN)

( * ) Notice: Subject to any disclaimer, the term of this patent is extended or adjusted under 35 U.S.C. 154(b) by 0 days.

(21) Appl. No.: 19/021,932

(22) Filed: Jan. 15, 2025

(65) Prior Publication Data

US 2025/0222552 A1 Jul. 10, 2025

Related U.S. Application Data

(63) Continuation of application No. PCT/CN2024/139941, filed on Dec. 17, 2024.

(30) Foreign Application Priority Data

May 29, 2024 (CN) ..... 202410674721.4

(51) Int. Cl.
*B24B 9/00* (2006.01)
*B24B 27/00* (2006.01)
*B24B 41/06* (2012.01)

(52) U.S. Cl.
CPC ..... *B24B 9/005* (2013.01); *B24B 27/0069* (2013.01); *B24B 41/068* (2013.01)

(58) Field of Classification Search
CPC ..... B24B 9/002; B24B 9/005; B24B 9/10; B24B 9/18; B24B 27/0069; B24B 41/02; B24B 41/068; B28D 7/04; B23Q 1/26; B23Q 1/72; B23Q 1/74; B65G 47/24; B65G 13/065; B65G 13/12
USPC ..... 451/64, 182, 184, 188, 260, 411; 125/35
See application file for complete search history.

(56) References Cited

U.S. PATENT DOCUMENTS

2008/0009229 A1* 1/2008 Sandri ..... B65G 49/067 451/64
2013/0202394 A1 8/2013 Hashimoto
2015/0068867 A1* 3/2015 Nishimura ..... B65G 49/065 198/373

(Continued)

FOREIGN PATENT DOCUMENTS

CN 115106453 A 9/2022
CN 117465759 A 1/2024
KR 100868486 B1 11/2008

*Primary Examiner* — Brian D Keller
*Assistant Examiner* — Marcel T Dion

(57) ABSTRACT

An edge polishing system with an edge alignment function for plates, including an edge polishing machine and a plate feeding platform. The plate feeding platform includes a frame assembly, a conveyor belt mechanism, a lifting mechanism, a blocking mechanism and a plate pressing mechanism. The frame assembly includes a movable frame and a fixed frame articulated with the movable frame. The conveyor belt mechanism is arranged on the movable frame. The lifting mechanism is arranged between the movable frame and the fixed frame. The blocking mechanism is arranged on an end of the movable frame. The plate pressing mechanism is arranged above the conveyor belt mechanism.

4 Claims, 7 Drawing Sheets

(56) References Cited

U.S. PATENT DOCUMENTS

| | | | | |
|---|---|---|---|---|
| 2023/0127250 | A1* | 4/2023 | Giese | B24B 49/04<br>451/11 |
| 2024/0190752 | A1* | 6/2024 | Bando | C03C 19/00 |
| 2024/0317628 | A1* | 9/2024 | Bando | C03B 33/033 |
| 2024/0351799 | A1* | 10/2024 | Obata | B65G 47/244 |

* cited by examiner

EDGE POLISHING SYSTEM WITH EDGE ALIGNMENT FUNCTION FOR PLATES

CROSS-REFERENCE TO RELATED APPLICATIONS

This application is a continuation of International Patent Application No. PCT/CN2024/139941, filed on Dec. 17, 2024, which claims the benefit of priority from Chinese Patent Application No. 202410674721.4, filed on May 29, 2024. The content of the aforementioned application, including any intervening amendments thereto, is incorporated herein by reference in its entirety.

TECHNICAL FIELD

This application relates to plate processing devices, and more particularly to an edge polishing system with an edge alignment function for plates.

BACKGROUND

Plate is a flat, rectangular and standard-sized building material commonly used in the construction of walls, ceilings or floors. The rapid development of the construction industry leads to a vigorous growth in the demand for plates. In the practical application, it is often required to process the plates in advance.

At present, the plates are usually conveyed by means of a roller conveyor. During the conveying process, the plates will deviate from the preset conveying direction to a certain extent. However, side edges of the plates need to be polished, and during the polishing process, the side edges of the plate need to be aligned with an edge polishing device. In the prior art, a pneumatic cylinder is usually set on one side of a roller conveyor, and the roller table can be raised by the pneumatic cylinder, so that the side edge of the plate abuts against the other side of the roller conveyor to realize alignment. However, due to the large space occupation, a stroke of a telescopic rod of the pneumatic cylinder is seriously limited, such that the existing edge polishing device cannot adapt to a variety of plates with different sizes. In addition, the force applied by the pneumatic cylinder to the roller conveyor is strong, which may cause the plate to fall from the roller conveyor, thereby damaging the plate.

SUMMARY

An object of this application is to provide an edge polishing system with an edge alignment function for plates to solve the above problems that the existing edge polishing devices cannot adapt to a variety of plates with different sizes due to structural limitations, and the plates are easy to fall from a roller conveyor when the roller conveyor is elevated.

Technical solutions of the present disclosure are described as follows.

An edge polishing system with an edge alignment function for plates is provided, comprising:

an edge polishing machine; and a plate feeding platform;

wherein the plate feeding platform is located on a plate feeding end of the edge polishing machine; the plate feeding platform comprises a frame assembly, a conveyor belt mechanism, a lifting mechanism, a blocking mechanism and a plate pressing mechanism;

the frame assembly comprises a movable frame and a fixed frame, and the fixed frame is articulated with the movable frame;

the conveyor belt mechanism is arranged on the movable frame, and is configured to convey a plate;

the lifting mechanism is arranged between the movable frame and the fixed frame, and is configured to drive the movable frame to rotate upward with an articulated connection between the fixed frame and the movable frame as a rotating shaft; and a conveying direction of the conveyor belt mechanism is parallel to an axis of the rotating shaft;

the blocking mechanism is arranged on the movable frame; and the blocking mechanism is configured to block the plate from sliding out of the movable frame, and align with a side edge of the plate in response to a case that the movable frame is driven to rotate upward; and the plate pressing mechanism is arranged above the conveyor belt mechanism, and is configured to press the plate against the conveyor belt mechanism.

In an embodiment, the plate pressing mechanism comprises a support frame, a first driving component and a plate pressing frame; the support frame is arranged on the frame assembly; a fixing end of the first driving component is arranged on the support frame, and a driving end of the first driving component is connected with the plate pressing frame, so that the plate pressing frame is suspended above the conveyor belt mechanism; the plate pressing frame is provided with at least two first roller groups side by side along an X-axis direction for pressing the plate, and the X-axis direction is the conveying direction; and the first driving component is configured to drive the plate pressing frame to be close to or away from the conveyor belt mechanism.

In an embodiment, the blocking mechanism comprises an edge-holding frame and a plurality of edge-holding rollers; and the edge-holding frame is connected with a first end of the movable frame; and the plurality of edge-holding rollers are rotatably arranged on the edge-holding frame, and are arranged spaced apart along the X-axis direction.

In an embodiment, the plate pressing mechanism further comprises an adjustment assembly; the adjustment assembly comprises a first connecting base, a second driving component, a limiting guide rod, a connecting rod, a first position sensor, a second position sensor and a plurality of abutting blocks;

the first connecting base is connected with a side of the fixed frame close to the blocking mechanism; the second driving component is arranged at an outer side of the first connecting base; a driving end of the second driving component passes through the first connecting base, and is connected with an outer side of the connecting rod; a first end of the limiting guide rod is connected with the outer side of the connecting rod, and a second end of the limiting guide rod passes through the first connecting base and is in slidable connection with the first connecting base; the plurality of abutting blocks are arranged spaced apart on an inner side of the connecting rod; the second driving component is configured to drive each of the plurality of abutting blocks to extend or retract from a gap between corresponding adjacent two of the plurality of edge-holding rollers through the connecting rod; and the first position sensor and the second position sensor are arranged on the frame assembly; the first position sensor and the second position sensor are electrically connected with the second driving component; and the first position sensor and the second position sensor are configured to detect whether two ends of the plate abut against the blocking mechanism.

In an embodiment, a second end of the movable frame extends outwards to form an extension frame; and the extension frame is provided with a second roller group.

In an embodiment, the edge polishing system further comprises an auxiliary sliding mechanism; the auxiliary sliding mechanism comprises a third driving component, a transmission assembly, a roller frame and a plurality of third roller groups;

the conveyor belt mechanism comprises a plurality of conveyor belt units; the plurality of conveyor belt units are arranged side by side on the movable frame along a Y-axis direction, and the Y-axis direction is a direction perpendicular to the conveying direction; the roller frame is connected with the transmission assembly, and is arranged below the movable frame; the plurality of third roller groups are arranged on the roller frame; and each of the plurality of third roller groups is located a gap between corresponding adjacent two of the plurality of conveyor belt units;

the third driving component is fixed on the movable frame; the transmission assembly is drivably connected with the third driving component, and the transmission assembly is articulated with the movable frame, so as to drive each of the plurality of third roller groups to extend or retract from the gap between corresponding adjacent two of the plurality of conveyor belt units.

In an embodiment, the transmission assembly comprises a push rod, a linkage arm, a first linkage rod, a first transmission bent arm, a first lifting base, a second linkage rod, a second transmission bent arm and a second lifting base;

a first end of the push rod is connected with the third driving component, and a second end of the push rod is articulated with a first end of the linkage arm; the first linkage rod is provided on the second end of the movable frame, and is rotated around the X-axis direction; a second end of the linkage arm is connected with the first linkage rod; the first lifting base is arranged on a first end of the roller frame, and a second lifting base is arranged on a second end of the roller frame; the third driving component is located between the first lifting base and the second lifting base; a first end of the first transmission bent arm is articulated with the first lifting base, and a second end of the first transmission bent arm is connected with the first linkage rod;

the second linkage rod is provided on the first end of the movable frame, and is rotated around the X-axis direction; a first end of the second transmission bent arm is articulated with the second lifting base, and a second end of the second transmission bent arm is connected with the second linkage rod.

In an embodiment, the frame assembly further comprises a leveling assembly; the leveling assembly comprises a second connecting base and a leveling screw; a top of the connecting base is provided with a screw hole; an end of the leveling screw is in threaded connection with the screw hole; a top of the leveling screw is configured to abut against the second end of the movable frame in response to a case that the movable frame is placed horizontally; and a top of the second connecting base is fixed on an end of the fixed frame.

In an embodiment, the lifting mechanism comprises a pneumatic cylinder and a gas tank; a fixing end of the pneumatic cylinder is arranged on the fixed frame, and a driving end of the pneumatic cylinder is articulated with the second end of the movable frame; and the gas tank is communicated with the pneumatic cylinder, and is configured to provide a compressed gas to the pneumatic cylinder.

In an embodiment, the fixed frame is provided with an articulating base; and a bottom of the movable frame is articulated with the articulating base.

The present disclosure has the following beneficial effects.

The edge polishing system provided herein is structurally-simple and readily-operable. Through the cooperation of the frame assembly, the lifting mechanism and the blocking mechanism, the edge alignment is achieved, and further, the plate pressing mechanism is provided to press the plate against the conveyor belt mechanism. The plate can slide under the action of gravity to achieve the edge alignment, and can be conveyed to the edge polishing machine, so that the plate edge and a positioning edge remain in the same straight line, which is conducive to the subsequent polishing operation. This application not only improves the polishing precision, but also enhances the conveying accuracy and reliability of plates, thereby satisfying the industrial processing needs of plates.

Figure 1:
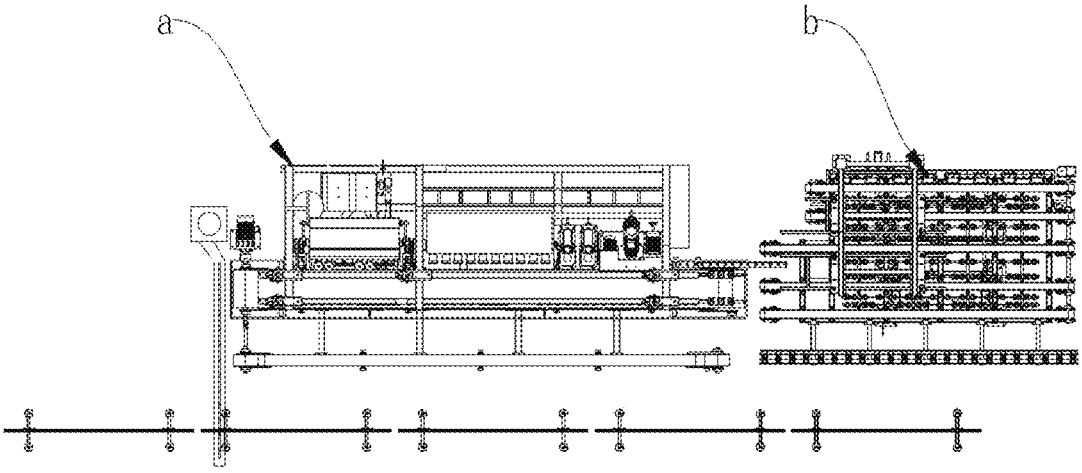
FIG. 1 is a top view of an edge polishing system according to an embodiment of the present disclosure.
Figure 2:
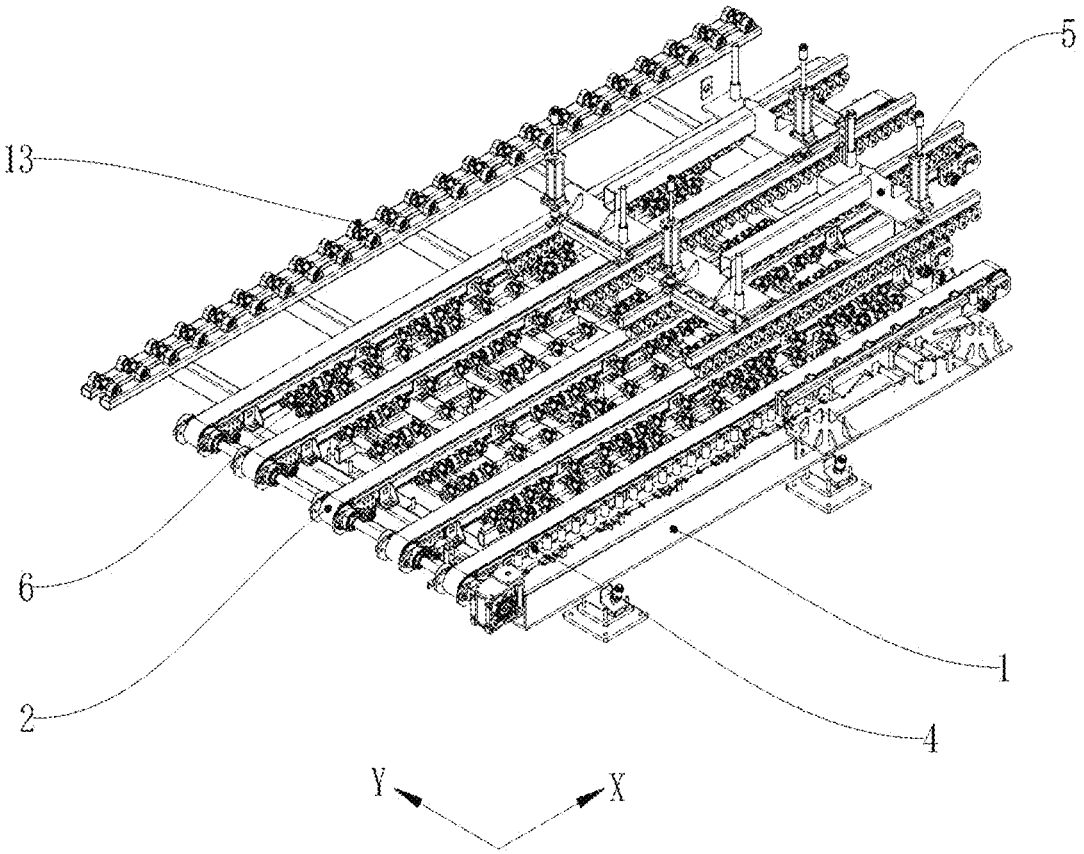
FIG. 2 is a structural diagram of a plate feeding platform according to an embodiment of the present disclosure.
Figure 3:
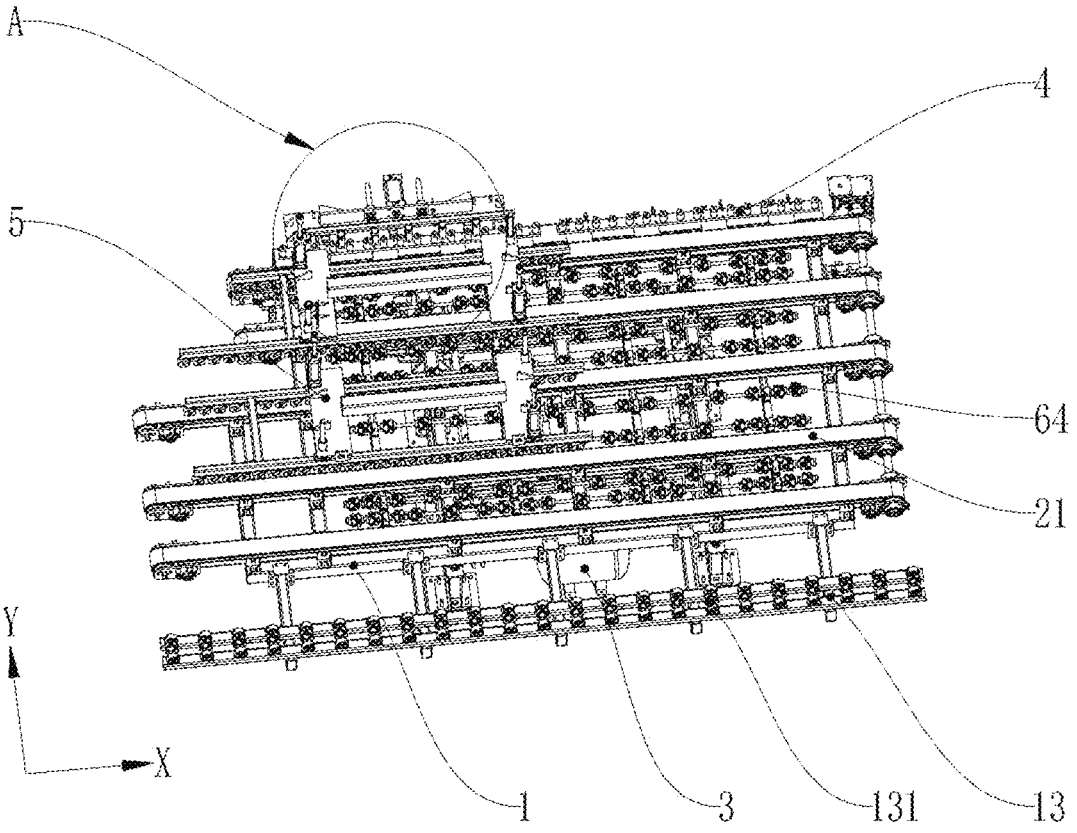
FIG. 3 is a structural diagram of the plate feeding platform of FIG. 2 from another perspective of view.
Figure 4:
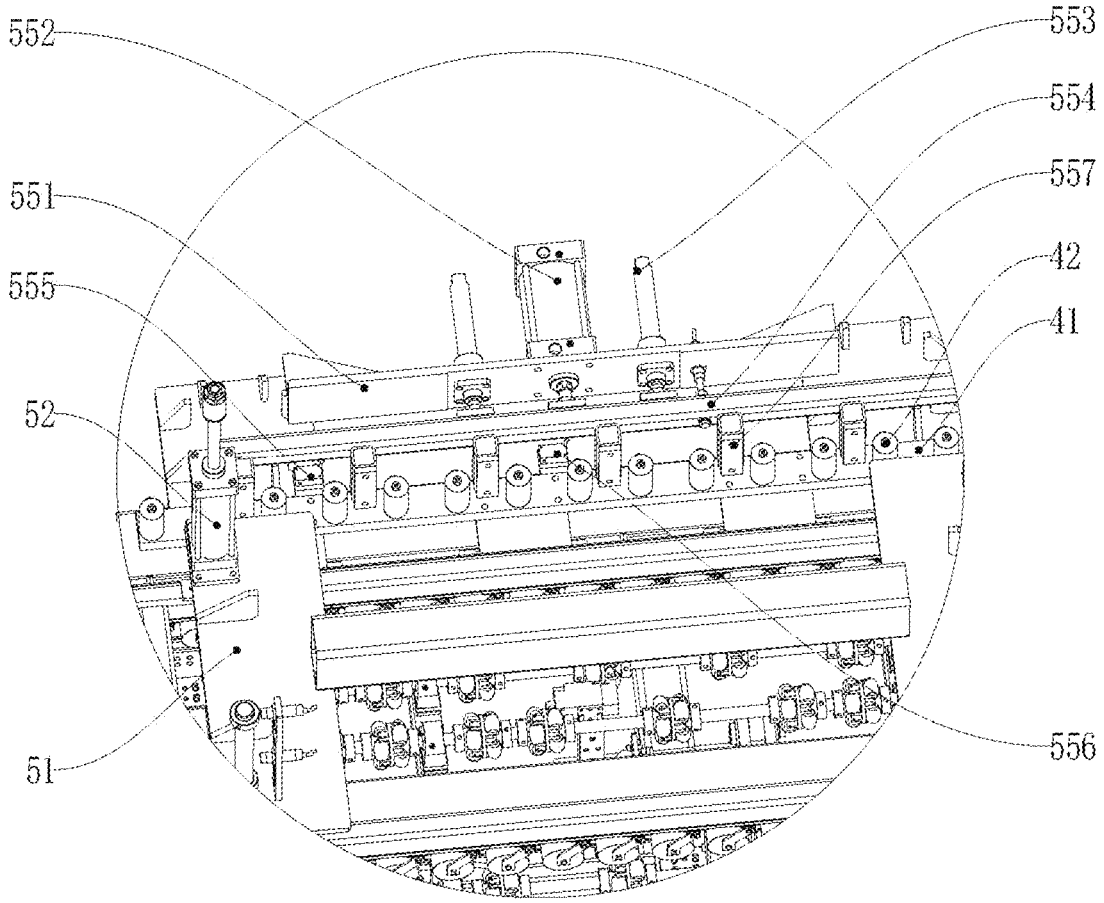
FIG. 4 is an enlarged view of portion "A" in FIG. 3.
Figure 5:
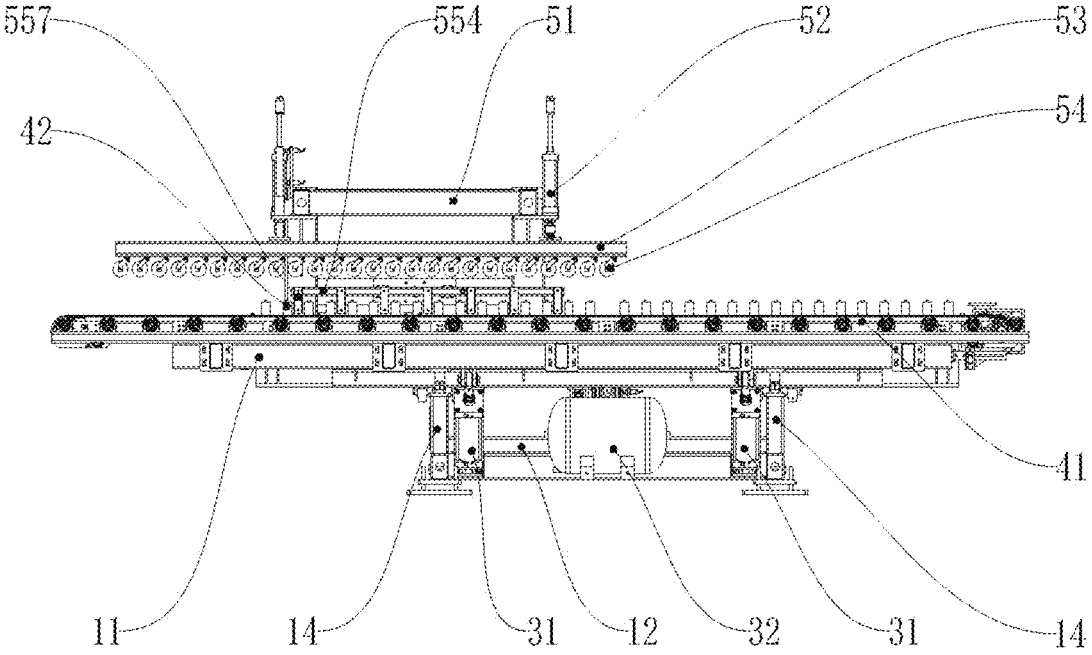
FIG. 5 is a side view of the plate feeding platform according to an embodiment of the present disclosure.

In Figures: edge polishing machine a; plate feeding platform b; frame assembly 1; conveyor belt mechanism 2; lifting mechanism 3; blocking mechanism 4; plate pressing mechanism 5; and auxiliary sliding mechanism 6;

movable frame 11; fixed frame 12; extension frame 13; leveling assembly 14; conveyor belt unit 21; pneumatic cylinder 31; gas tank 32; edge-holding frame 41; edge-holding roller 42; support frame 51; first driving component 52; plate pressing frame 53; first roller group 54; third driving component 61; transmission assembly 62; roller frame 63; and third roller group 64; and articulating base 121; second roller group 131; first connecting base 551; second driving component 552; limiting guide rod 553; connecting rod 554; first position sensor 555; second position sensor 556; abutting block 557; push rod 621; linkage arm 622; first linkage rod 623; first transmission bent arm 624; first lifting base 625; second linkage rod 626; second transmission bent arm 627; and second lifting base 628.

DETAILED DESCRIPTION OF EMBODIMENTS

Embodiments of the present disclosure will be described in detail below, and are shown in the accompanying drawings, where identical or similar labels indicate identical or similar elements or components with identical or similar functions. Embodiments described according to the accompanying drawings are illustrative, which are intended to explain the present disclosure rather than limiting the disclosure.

It should be noted that the terms, such as "X-axis", "Y-axis", "up", "down", "vertical", "horizontal", "top", "bottom", "inside", "outside" and other directional indications used herein, are used for illustrating orientation or position relationship shown in the accompanying drawings, which are intended to facilitate and simplify the description of the present disclosure, rather than indicating or implying the indicated components must have a specific orientation and be constructed and operated in a specific orientation, therefore, it is not intended to limit this application. In addition, a feature defined with "first" or "second" may explicitly or implicitly indicates the inclusion of at least one of such features, which is merely intended for distinguishment and description.

Unless otherwise specified, the term "multiple" used in the description means two or more.

As used herein, unless otherwise expressly specified and limited, the terms "mounting", "linkage" and "connection" should be interpreted in a broad sense. For example, it can be "fixed connection", "removable connection" or "integral connection"; it can be "mechanical connection" or "electrical connection"; it can be "direct connection" or "indirect connection through an intermediate medium"; and it can be internal communication or interaction between two components. For those of ordinary skill in the art, the specific meaning of these terms can be understood in specific cases.

Referring to FIGS. 1-7, an edge polishing system with an edge alignment for plates includes an edge polishing machine a and a plate feeding platform b. The plate feeding platform b is located on a plate feeding end of the edge polishing machine a. The plate feeding platform b includes a frame assembly 1, a conveyor belt mechanism 2, a lifting mechanism 3, a blocking mechanism 4 and a plate pressing mechanism 5.

The frame assembly 1 includes a movable frame 11 and a fixed frame 12. The fixed frame 12 is articulated with the movable frame 11.

The conveyor belt mechanism 2 is arranged on the movable frame 11, and is configured to convey a plate.

The lifting mechanism 3 is arranged between the movable frame 11 and the fixed frame 12, and is configured to drive the movable frame 11 to rotate upward with an articulated connection between the fixed frame 12 and the movable frame 11 as. A conveying direction of the conveyor belt mechanism 2 is parallel to an axis of the rotating shaft.

The blocking mechanism 4 is arranged on a first end of the movable frame 11. The blocking mechanism 4 is configured to block the plate from sliding out of the movable frame, and align with a side edge of the plate in response to a case that the movable frame 11 is driven to rotate upward.

The plate pressing mechanism 5 is arranged above the conveyor belt mechanism 2, and is configured to press the plate against the conveyor belt mechanism 2.

The plate feeding platform b is arranged on the plate feeding end of the edge polishing machine a. The plate feeding platform b includes the conveyor belt mechanism 2, the lifting mechanism 3, the blocking mechanism 4 and the plate pressing mechanism 5. The conveyor belt mechanism 2 is configured to convey the plate to the plate feeding platform b, and convey out the plate which finished edge alignment. The lifting mechanism 3 is configured to lift the movable frame 11, so that the movable frame 11 rotates with an articulated connection between the fixed frame 12 and the movable frame 11 as a rotating shaft, and the movable frame 11 tilts to drive the plate to be close to the blocking mechanism 4. The side edge of the plate abuts against the blocking mechanism 4. The plate pressing mechanism 5 is configured to make the plate abut against the conveyor belt mechanism 2, so as to ensure the conveyor belt mechanism 2 can still convey the plate in response to a case that the lifting mechanism 3 lifts the movable frame 11, achieving the edge alignment during conveying, which improves an efficiency of the edge alignment and makes a position of the plate relatively fixed. The plate feeding platform b can convey out the plate which finished edge alignment through the conveyor belt mechanism 2, and then the plate can be subjected to edge polishing.

The conveyor belt mechanism 2 conveys the plate to the plate feeding platform b in response to a case that the edge alignment is needed, the plate pressing mechanism 5 make the plate abut against the conveyor belt mechanism 2, the lifting mechanism 3 lifts the movable frame 11, and the movable frame 11 rotates according to the rotating shaft at the articulated connection of the fixed frame 12 and the movable frame 11, in this way, there is an angle between the movable frame 11 and the fixed frame 12, the plate is on the conveyor belt mechanism 2 and slides to the blocking mechanism 4, so that a side edge of the plate abuts against the blocking mechanism 4, and then the lifting mechanism 3 drives the movable frame 11 to reset, so that the movable frame 11 is parallel to a horizontal plane, and the conveyor belt mechanism 2 conveys out the plate which finished edge alignment.

The plate feeding platform b has a simple structure and convenient operation. The plate feeding platform b realizes the edge alignment through the coordination of the frame assembly 1, the lifting mechanism 3 and the blocking mechanism 4, while the plate abuts against the conveyor belt mechanism 2 through the plate pressing mechanism 5. The plate achieves edge alignment through sliding by its own weight, and can be conveyed to the edge polishing machine a to ensure the conveying standard, so that an edging line and a positioning edge remain in a same straight line, which is conducive to the plate to be further ground and processed, having the accurate edge polishing, effectively ensuring the accuracy and reliability of the plate conveying, and satisfying the needs of the processing of plate polishing.

In an embodiment, the plate pressing mechanism 5 includes a support frame 51, a first driving component 52 and a plate pressing frame 53. The support frame 51 is arranged on the frame assembly 1. A fixing end of the first driving component 52 is arranged on the support frame 51, and a driving end of the first driving component 52 is connected with the plate pressing frame 53, so that the plate pressing frame 53 is suspended above the conveyor belt mechanism 2. The plate pressing frame 53 is provided with at least two first roller groups 54 side by side along an X-axis direction for pressing the plate, and the X-axis direction is the conveying direction. The first driving component 52 is configured to drive the plate pressing frame 53 to be close to or away from the conveyor belt mechanism 2.

The at least two first roller groups 54 include a plurality of first rollers for plate pressing arranged along the X-axis direction. The plurality of first rollers are mounted on a bottom of the plate pressing frame 53. A friction between the plate and the plate pressing frame 53 is reduced while the plate is ensured to abut against the conveyor belt mechanism 2, so that the plate abut against the conveyor belt mechanism 2 while being conveyed, which improves the conveying efficiency.

The first driving component 52 can be a telescopic cylinder or a driving motor. In an embodiment, the number of the plate pressing frame 53 is two and the number of the first driving component 52 is four. The driving end of the first driving component 52 are arranged downwardly. The two plate pressing frames 53 are arranged side by side, and both ends of each of the two plate pressing frames 53 are connected with the driving end of the first driving component 52. In an embodiment, the plate pressing mechanism 5 is provided with a guide rod. A first end of the guide rod is connected with the plate pressing frame 53, and a second end of the guide rod is slidably connected with the support frame 51. The guide rod is configured to allow the plate pressing frame 53 move along a vertical direction and avoid the plate pressing frame 53 to move along other directions, which improves a structural stability of the plate pressing mechanism 5. In an embodiment, each plate pressing frame 53 is equipped with two first driving components 52 and two guide rods, four corners of each plate pressing frame 53 are connected with the two first driving components 52 and the two guide rods, respectively, which further improves the structural stability.

In an embodiment, the blocking mechanism 4 includes an edge-holding frame and a plurality of edge-holding rollers.

The edge-holding frame 41 is connected with a first end of the movable frame. The plurality of edge-holding rollers 42 are arranged on the edge-holding frame 41, and are arranged spacing from each other along the X-axis direction.

The plate abuts against side walls of the plurality of edge-holding rollers 42, and the plurality of edge-holding rollers 42 are rotatably mounted on the edge-holding frame 41. Therefore, when the movable frame 11 is lifted, the conveyor belt mechanism 2 can continue to operate, so that the plate moves along the plurality of edge-holding rollers 42. By adopting the above structure, when the plate on the movable frame 11 is lifted, the friction between the plate and the blocking mechanism 4 is reduced, and the plate can continue to move, which improves the conveying efficiency.

In an embodiment, the plate pressing mechanism 5 further includes an adjustment assembly. The adjustment assembly includes a first connecting base 551, a second driving component 552, a limiting guide rod 553, a connecting rod 554, a first position sensor 555, a second position sensor 556 and a plurality of abutting blocks 557.

The first connecting base 551 is connected with a side of the fixed frame 12 close to the blocking mechanism 4. The second driving component 552 is arranged outside the first connecting base 551. A driving end of the second driving component 552 passes through the first connecting base 551 and is connected with an outer side of the connecting rod 554. A first end of the limiting guide rod 553 is connected with the outer side of the connecting rod 554, and a second end of the limiting guide rod 553 passes through the first connecting base 551 and is slidably connected with the first connecting base 551. The plurality of abutting blocks 557 are arranged spaced apart on an inter side of the connecting rod 554. The second driving component 552 is configured to drive each of the plurality of abutting blocks 557 to extend or retract from a gap between corresponding adjacent two of the plurality of edge-holding rollers 42 through the connecting rod 554.

The first position sensor 555 and the second position sensor 556 are arranged on the frame assembly 1, and the first position sensor 555 and the second position sensor 556 are electrically connected with the second driving component 552, respectively. The first position sensor 555 and the second position sensor 556 are both configured to detect whether two ends of the plate abut against the blocking mechanism 4.

The first position sensor 555 and the second position sensor 556 detect whether the two ends of the plate abut against the blocking mechanism 4, so as to detect whether the side edge of the plate completely abuts against the blocking mechanism 4. When the side edge of the plate abuts against the plurality of edge-holding rollers 42 on a side of the first position sensor 555, the first position sensor 555 obtains a sensing signal. Similarly, when the side edge of the plate abuts against the plurality of edge-holding rollers 42 on a side of the second position sensor 556, the second position sensor 556 obtains the sensing signal. If the first position sensor 555 and the second position sensor 556 obtain the sensing signal at the same time, the side edge of the plate completely abuts against the plurality of edge-holding rollers 42. If one of the first position sensor 555 and the second position sensor 556 cannot obtain the sensing signal, a corresponding end of the side edge of the plate cannot abut against the plurality of edge-holding rollers 42.

The driving end of the second driving component 552 extends to drive the connecting rod 554 to move along a direction close to the plurality of edge-holding rollers 42, so that each of the plurality of abutting blocks 557 extend the gap between corresponding adjacent two of the plurality of edge-holding rollers 42 to lift the plate. Then, the driving end of the second driving component 552 retracts to drive the connecting rod 554 to move along a direction away from the plurality of edge-holding rollers 42, so that each of the plurality of abutting blocks 557 retract from the gap between corresponding adjacent two of the plurality of edge-holding rollers 42, so that the side edge of the plate re-contacts the plurality of edge-holding rollers 42.

By adopting the above structure, a position of the plate can be adjusted twice, so that the side edge of the plate abuts against the plurality of edge-holding rollers 42, so as to further ensure the accuracy and reliability of the plate conveying.

In an embodiment, a second end of the movable frame 11 extends outwards to form an extension frame 13. The extension frame 13 is provided with a second roller group 131.

There is a large gap between a width and a length of the plate of the prior art, however, four side edges of the plate are needed to be ground. Therefore, the extension frame 13 is provided. The extension frame 13 is configured to extend an allowable length of the movable frame 11. When the edge polishing is needed on a side edge of a length direction of the plate, a first end of a width direction of the plate abuts against the plurality of edge-holding rollers 42, and a second end of the width direction of the plate is located on the second roller group 131. The second roller group 131 is configured for auxiliary conveying, which reduces a friction between a bottom of the plate and the extension frame 13, facilitates the plate conveying, and improves a conveying speed.

The second roller group 131 is composed of a plurality of second rollers long the X-axis direction. The second rollers are rotatably mounted on the extension frame 13.

In an embodiment, the edge polishing system further includes an auxiliary sliding mechanism 6. The auxiliary sliding mechanism 6 includes a third driving component 61, a transmission assembly 62, a roller frame 63 and a plurality of third roller groups 64.

The conveyor belt mechanism 2 includes a plurality of conveyor belt units 21. The plurality of conveyor belt units 21 are arranged side by side on the movable frame 11 along a Y-axis direction, and the Y-axis direction is a direction perpendicular to the conveying direction. The roller frame 63 is connected with the transmission assembly 63, and is arranged below the movable frame 11. The plurality of third roller groups 64 are arranged on the roller frame 63. Each of the plurality of third roller groups 64 is located a gap between corresponding adjacent two of the plurality of conveyor belt units 21.

The third driving component 61 is fixed on the movable frame 11. The transmission assembly 62 is drivably connected with the third driving component 61, and the transmission assembly 62 is articulated with the movable frame 11, so as to drive the each of the plurality of third roller groups 64 to extend or retract from the gap between corresponding adjacent two of the plurality of conveyor belt units 21.

Each of the plurality of conveyor belt units 21 can be a conveyor belt structure of the prior art. The plurality of conveyor belt units 21 are configured to convey the plate, which effectively ensures the accuracy and reliability of the plate conveying.

The third driving component 61 drives the roller frame 63 to move upwardly or downwardly through the transmission assembly 62, so as to drive each of the plurality of third roller groups 64 on the roller frame 63 to extend or retract from the gap between corresponding adjacent two of the plurality of conveyor belt units 21.

By adopting the above structure, each of the plurality of third roller groups 64 is arranged between corresponding adjacent two of the plurality of conveyor belt units 21, when the edge alignment is needed, the third driving component 61 drives each of the plurality of third roller groups 64 to extend the gap between corresponding adjacent two of the plurality of conveyor belt units 21 to lift the plate, so that the plate is easy to move close to the blocking mechanism 4, preventing a friction between the plate and the plurality of conveyor belt units 21 from being too large which results in the plate cannot slide to the blocking mechanism 4 and the edge alignment cannot be achieve. During the plate conveying, the third driving component 61 drives each of the plurality of third roller groups 64 to retract from the gap between corresponding adjacent two of the plurality of conveyor belt units 21, preventing the plurality of third roller groups 64 from lifting the plate which results in the plurality of conveyor belt units 21 cannot convey the plate.

In an embodiment, the transmission assembly 62 includes a push rod 621, a linkage arm 622, a first linkage rod 623, a first transmission bent arm 624, a first lifting base 625, a second linkage rod 626, a second transmission bent arm 627 and a second lifting base 628.

A first end of the push rod 621 is connected with the third driving component 61, and a second end of the push rod 621 is articulated with a first end of the linkage arm 622. The first linkage rod 623 is rotatably provided on the end of the movable frame 11, and is rotatable around the X-axis shaft. A second end of the linkage arm 622 is connected with the first linkage rod 623. The first lifting base 625 is arranged on a first end of the roller frame 63, and a second lifting base 628 is arranged on a second end of the roller frame 63. The third driving component 61 is located between the first lifting base 625 and the second lifting base 628. A first end of the first transmission bent arm 624 is articulated with the first lifting base 625, and a second end of the first transmission bent arm 624 is connected with the first linkage rod 623.

The second linkage rod 626 is rotatably provided on the end of the movable frame 11, and is rotatable around the X-axis shaft. A first end of the second transmission bent arm 627 is articulated with the second lifting base 628, and a second end of the second transmission bent arm 627 is connected with the second linkage rod 626.

The plurality of third roller groups 64 include two roller shafts arranged side by side. Each of the two roller shafts is provided with a plurality of guide rollers spacing from each other. The guide plurality of guide rollers are rotatably mounted on each of the two roller shafts. The two roller shafts are arranged on the roller frame 63.

Figure 6:
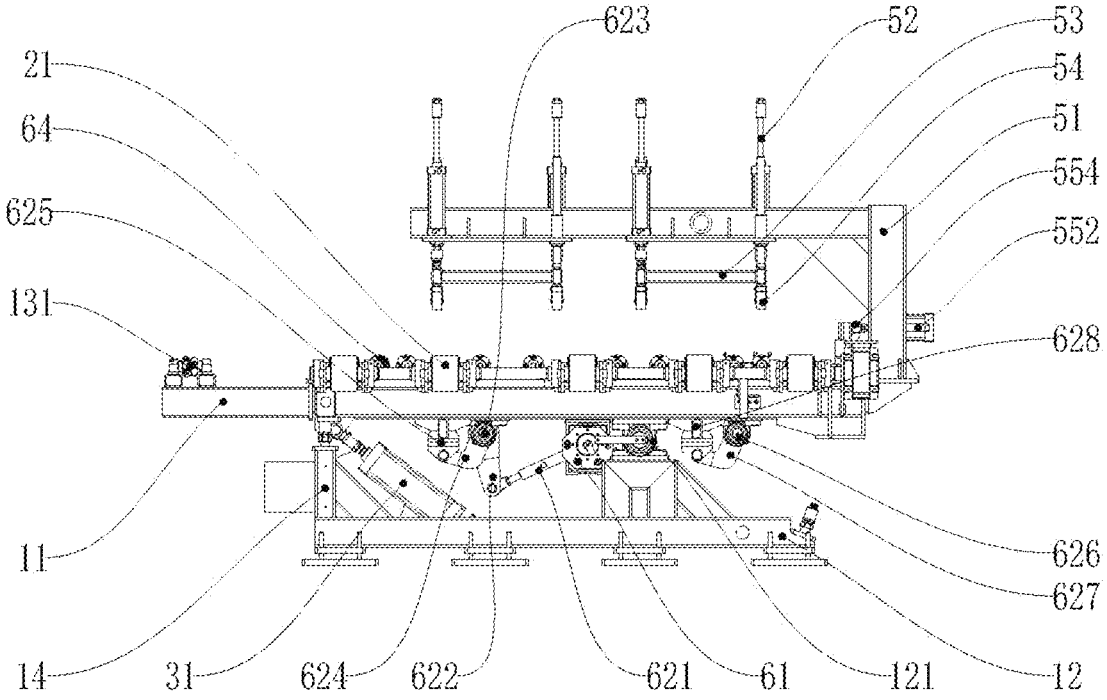
FIG. 6 is a structural diagram of the plate feeding platform of FIG. 5 from another perspective of view.
Figure 7:
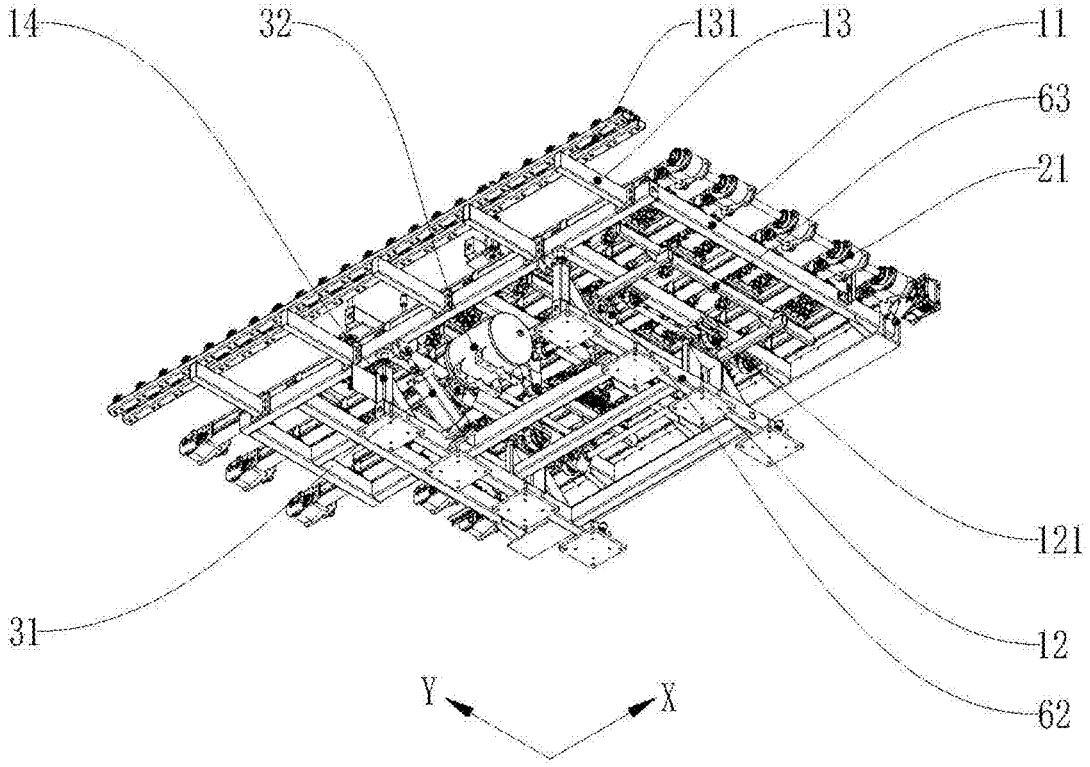
FIG. 7 is a structural diagram of a bottom of the plate feeding platform according to an embodiment of the present disclosure.

Referring to FIG. 6, the third driving component 61 is a driving motor. When the plurality of third roller groups 64 need to be lifted, the third driving component 61 drives the push rod 621 to extend forwards, and the push rod 621 drives the linkage arm 622 to rotate clockwise according to an axis of the first linkage rod 623 as a rotating shaft to drive the first linkage rod 623 to rotate clockwise, so that the first linkage rod 623 drives the first transmission bent arm 624 to rotate clockwise, and the first transmission bent arm 624 lifts the first lifting base 625, and the first lifting base 625 lifts the roller frame 63. The roller frame 63 moves upwards to drive each of the plurality of third roller groups 64 to extend the gap between corresponding adjacent two of the plurality of conveyor belt units 21, while the roller frame 63 drives the second lifting base 628 to move upwards, so as to drive the second transmission bent arm 627 to rotate clockwise according to an axis of the second linkage rod 626 as a rotating shaft. The second lifting base 628 and the second transmission bent arm 627 are in collaboration with the first transmission bent arm 624 and the first lifting base 625 through the roller frame 63, so that a force is applied evenly on the roller frame 63 to ensure the roller frame 63 moves upward entirely, avoiding the roller frame 63 tilting to one side which affects a guiding effect on the plate.

When the plurality of third roller groups 64 need to be retracted, the third driving component 61 drives the push rod 621 to retract backwards, and the push rod 621 drives the linkage arm 622 to rotate anti-clockwise according to the axis of the first linkage rod 623 as the rotating shaft to drive the first linkage rod 623 to rotate anti-clockwise, so that the first linkage rod 623 drives the first transmission bent arm 624 to rotate anti-clockwise, and the first transmission bent arm 624 lowers the first lifting base 625, and the first lifting base 625 drives the roller frame 63 to retract, and each of the plurality of third roller groups 64 retracts from the gap between corresponding adjacent two of the plurality of conveyor belt units 21.

In an embodiment, the frame assembly 1 further includes a leveling assembly 14. The leveling assembly includes a second connecting base and a leveling screw. A top of the second connecting base is provided with a screw hole. An end of the leveling screw is in threaded connection with the screw hole. When the movable frame 11 is placed horizontally, a top of the leveling screw abuts against the second end of the movable frame. A top of the second connecting base is fixed on an end of the fixed frame 12.

The leveling assembly 14 can be an adjustment screw of the prior art. By controlling a of the leveling screw protruding from the screw hole, a tilting angle of the movable frame 11 in a horizontal state is adjusted to realize leveling. In addition, when the movable frame 11 is in the horizontal state, the leveling assembly 14 can act as an auxiliary support for the movable frame 11.

In an embodiment, the lifting mechanism 3 includes a pneumatic cylinder 31 and a gas tank 32. A fixing end of the pneumatic cylinder 31 is arranged on the fixed frame 12, and a driving end of the pneumatic cylinder 31 is articulated with the end of the movable frame 11. The gas tank 32 is communicated with the pneumatic cylinder 31, and is configured to provide a compressed gas to the pneumatic cylinder 31.

The gas tank 32 is configured to provide the compressed gas to the pneumatic cylinder 31, so that the driving end of the pneumatic cylinder 31 is extended or retracted to control the gas tank 32 to discharge or intake an air, and the pneumatic cylinder 31 is control to be extended or retracted. Such structure is simple and is convenient to be operated, which effectively ensures a stability of the movable frame 11 during lifting. In an embodiment, the number of the pneumatic cylinder 31 is two. The two cylinders 31 are arranged on both sides of the gas tank 32, respectively. The two cylinders 31 are extended or retracted at the same time to achieve the rotation of the movable frame 11, so that the movable frame 11 is more stable during lifting and the swing caused by uneven force is avoided.

In an embodiment, the fixed frame 12 is provided with an articulating base 121. A bottom of the movable frame 11 is articulated with the articulating base 121.

In an embodiment, the fixed frame 12 is articulated with the articulating base 121 through the movable frame 11. By adjusting the leveling assembly 14, a length of the leveling assembly 14 is compatible with a height of the articulating base 121, so that the movable frame 11 is kept level. When the plate is normally conveyed, the movable frame 11 is parallel to the horizontal plane to avoid an accidental deviation of the position of the plate caused by an angle deviation during the conveyor belt mechanism 2 conveys the plate.

The technical principle of this application has been elaborated above with reference to the embodiments. The above description is intended to explain the principles of the present disclosure, and is not intended to limit this application in any way. Based on the embodiments of the present disclosure, other embodiments obtained by those of ordinary skill in the art without making creative effort shall fall within the scope of the present disclosure defined by the appended claims.

What is claimed is:

1. An edge polishing system with an edge alignment function for plates, comprising:

an edge polishing machine; and a plate feeding platform;

wherein the plate feeding platform is located on a plate feeding end of the edge polishing machine;

the plate feeding platform comprises a frame assembly, a conveyor belt mechanism, a lifting mechanism, a blocking mechanism and a plate pressing mechanism;

the frame assembly comprises a movable frame and a fixed frame, and the fixed frame is articulated with the movable frame;

the conveyor belt mechanism is arranged on the movable frame, and is configured to convey a plate;

the lifting mechanism is arranged between the movable frame and the fixed frame, and is configured to drive the movable frame to rotate upward with an articulated connection between the fixed frame and the movable frame as a rotating shaft; and a conveying direction of the conveyor belt mechanism is parallel to an axis of the rotating shaft;

the blocking mechanism is arranged on the movable frame; and the blocking mechanism is configured to block the plate from sliding out of the movable frame, and align with a side edge of the plate in response to a case that the movable frame is driven to rotate upward;

the plate pressing mechanism is arranged above the conveyor belt mechanism, and is configured to press the plate against the conveyor belt mechanism;

the plate pressing mechanism comprises a support frame, a first driving component and a plate pressing frame; the support frame is arranged on the frame assembly; a fixing end of the first driving component is arranged on the support frame, and a driving end of the first driving component is connected with the plate pressing frame, so that the plate pressing frame is suspended above the conveyor belt mechanism; the plate pressing frame is provided with at least two first roller groups side by side along an X-axis direction for pressing the plate; and the first driving component is configured to drive the plate pressing frame to be close to or away from the conveyor belt mechanism;

the blocking mechanism comprises an edge-holding frame and a plurality of edge-holding rollers;

the edge-holding frame is connected with a first end of the movable frame; and the plurality of edge-holding rollers are rotatably arranged on the edge-holding frame, and are arranged spaced apart along the X-axis direction;

the plate pressing mechanism further comprises an adjustment assembly; the adjustment assembly comprises a first connecting base, a second driving component, a limiting guide rod, a connecting rod, a first position sensor, a second position sensor and a plurality of abutting blocks;

the first connecting base is connected with a side of the fixed frame close to the blocking mechanism; the second driving component is arranged at an outer side of the first connecting base; a driving end of the second driving component passes through the first connecting base, and is connected with an outer side of the connecting rod; a first end of the limiting guide rod is connected with the outer side of the connecting rod, and a second end of the limiting guide rod passes through the first connecting base and is in slidable connection with the first connecting base; the plurality of abutting blocks are arranged spaced apart on an inner side of the connecting rod; the second driving component is configured to drive each of the plurality of abutting blocks to extend or retract from a gap between corresponding adjacent two of the plurality of edge-holding rollers through the connecting rod;

the first position sensor and the second position sensor are arranged on the frame assembly; the first position sensor and the second position sensor are electrically connected with the second driving component; and the first position sensor and the second position sensor are configured to detect whether two ends of the plate abut against the blocking mechanism;

a second end of the movable frame extends outwards to form an extension frame; and the extension frame is provided with a second roller group;

the edge polishing system further comprises an auxiliary sliding mechanism; the auxiliary sliding mechanism comprises a third driving component, a transmission assembly, a roller frame and a plurality of third roller groups;

the conveyor belt mechanism comprises a plurality of conveyor belt units; the plurality of conveyor belt units are arranged side by side on the movable frame along a Y-axis direction; the roller frame is connected with the transmission assembly, and is arranged below the movable frame; the plurality of third roller groups are arranged on the roller frame; and each of the plurality of third roller groups is located a gap between corresponding adjacent two of the plurality of conveyor belt units;

the third driving component is fixed on the movable frame; the transmission assembly is drivably connected with the third driving component, and the transmission assembly is articulated with the movable frame, so as to drive each of the plurality of third roller groups to extend or retract from the gap between corresponding adjacent two of the plurality of conveyor belt units;

the transmission assembly comprises a push rod, a linkage arm, a first linkage rod, a first transmission bent arm, a first lifting base, a second linkage rod, a second transmission bent arm and a second lifting base;

a first end of the push rod is connected with the third driving component, and a second end of the push rod is articulated with a first end of the linkage arm; the first linkage rod is provided on the second end of the movable frame, and is rotatable around the X-axis direction; a second end of the linkage arm is connected with the first linkage rod; the first lifting base is arranged on a first end of the roller frame, and a second lifting base is arranged on a second end of the roller frame; the third driving component is located between the first lifting base and the second lifting base; a first end of the first transmission bent arm is articulated with the first lifting base, and a second end of the first transmission bent arm is connected with the first linkage rod; and the second linkage rod is provided on the first end of the movable frame, and is rotatable around the X-axis direction; a first end of the second transmission bent arm is articulated with the second lifting base, and a second end of the second transmission bent arm is connected with the second linkage rod.

2. The edge polishing system of claim 1, wherein the frame assembly further comprises a leveling assembly; the leveling assembly comprises a second connecting base and a leveling screw; a top of the second connecting base is provided with a screw hole; an end of the leveling screw is in threaded connection with the screw hole; a top of the leveling screw is configured to abut against the second end of the movable frame in response to a case that the movable frame is placed horizontally; and a top of the second connecting base is fixed on an end of the fixed frame.

3. The edge polishing system of claim 1, wherein the lifting mechanism comprises a pneumatic cylinder and a gas tank; a fixing end of the pneumatic cylinder is arranged on the fixed frame, and a driving end of the pneumatic cylinder is articulated with the second end of the movable frame; and the gas tank is communicated with the pneumatic cylinder, and is configured to provide a compressed gas to the pneumatic cylinder.

4. The edge polishing system of claim 1, wherein the fixed frame is provided with an articulating base; and a bottom of the movable frame is articulated with the articulating base.

* * * * *